US006637619B2

(12) United States Patent
Chang

(10) Patent No.: US 6,637,619 B2
(45) Date of Patent: Oct. 28, 2003

(54) MACHINE FOR RELIABLY VENDING PRODUCTS ONE AT A TIME

(76) Inventor: Kil Jae Chang, T. PiCO. Korea Manufacturing, 321-37 Suksu, 2 Dong, Anyang City, Kyungdido (KR)

( * ) Notice: Subject to any disclaimer, the term of this patent is extended or adjusted under 35 U.S.C. 154(b) by 0 days.

(21) Appl. No.: 09/955,811

(22) Filed: Sep. 18, 2001

(65) Prior Publication Data

US 2002/0036209 A1 Mar. 28, 2002

Related U.S. Application Data

(63) Continuation-in-part of application No. 09/669,218, filed on Sep. 25, 2000, now Pat. No. 6,378,724, and a continuation-in-part of application No. 09/921,226, filed on Aug. 1, 2001.

(51) Int. Cl.[7] ..... A24F 15/04
(52) U.S. Cl. ..... 221/24; 221/155
(58) Field of Search ..... 221/24, 155, 97, 221/131, 132, 199, 277, 195, 282

(56) References Cited

U.S. PATENT DOCUMENTS

| | | | | |
|---|---|---|---|---|
| 629,505 | A | 7/1899 | Hollands | |
| 736,980 | A | 8/1903 | Kneedler | |
| 1,347,558 | A | 7/1920 | Simon | |
| 2,208,298 | A | 7/1940 | Mahaffey | 312/95 |
| 3,077,254 | A | 2/1963 | Goldfarb | 194/80 |
| 3,104,028 | A | 9/1963 | Brown | 221/86 |
| 4,284,206 | A | 8/1981 | Wittern | 221/90 |
| 4,876,532 | A | 10/1989 | Sauls | 340/689 |
| 5,339,985 | A | 8/1994 | Perez | 221/151 |
| 5,452,822 | A | 9/1995 | Haymond | 221/155 |
| 5,472,074 | A | 12/1995 | Milcetic | 194/342 |
| 5,485,939 | A | 1/1996 | Tucker | 221/86 |
| 5,732,852 | A | 3/1998 | Baker et al. | 221/116 |
| 5,782,378 | A | 7/1998 | Hart et al. | 221/24 |
| 5,833,117 | A | 11/1998 | Kovens et al. | 221/24 |
| 5,897,022 | A | 4/1999 | Mann | 221/24 |
| 6,056,151 | A | 5/2000 | Peery et al. | 221/24 |
| 6,378,724 | B1 * | 4/2002 | Chang | 221/24 |

* cited by examiner

*Primary Examiner*—Kenneth W. Noland
(74) *Attorney, Agent, or Firm*—Flanagan & Flanagan; John R. Flanagan

(57) ABSTRACT

A machine for vending products include a housing, an magazine indexing drive mechanism in the housing and drivingly coupled to a product storage and dispensing magazine at spaced apart lower and upper portions of the magazine, a plurality of ball bearings rotatably supporting the magazine on a product separation fixture in the housing, a resiliently yieldable mechanism supported on the separation fixture and having a spring-biased pivotally-movable flap operable to impart a positive downwardly-directed force on the lowermost product that will push it downward toward an opening in the housing, and portions of the housing and the separation fixture defining a path for passage of products to the opening which is located outwardly of and bypasses the drive mechanism.

17 Claims, 8 Drawing Sheets

MACHINE FOR RELIABLY VENDING PRODUCTS ONE AT A TIME

This application is a continuation-in-part of patent applications Ser. No. 09/669,218 filed Sep. 25, 2000 now U.S. Pat. No. 6,378,724 and Ser. No. 09/921,226 filed Aug. 1, 2001 now Publication No. 6520374/20030024944.

BACKGROUND OF THE INVENTION

1. Field of the Invention

The present invention generally relates to coin-operated vending machines and, more particularly, is concerned with a machine for reliably vending products one at a time.

2. Description of the Prior Art

One general type of product that is well-known and universally popular and thus desirable to be able to dispense reliably from a vending machine is a lollipop. The lollipop typically has an elongated thin stick-like handle for gripping by a consumer and a piece of candy of spherical, round or similar shape mounted on one end of the handle and covered by a wrapper of paper or the like prior to the purchase of the product by a consumer. Because of its makeup, the lollipop is difficult to store in large quantities in a vending machine and still be able to reliably and effectively dispense one at a time from the machine.

Vending machines of various constructions have been proposed in the prior art for dispensing a variety of products. Some representative examples of these prior art vending machines are found in U.S. Pat. No. 736,980 to Kneedler, U.S. Pat. No. 3,077,254 to Goldfarb, U.S. Pat. No. 5,339,985 to Perez, U.S. Pat. No. 5,452,822 to Haymond, U.S. Pat. No. 5,472,074 to Milcetic, U.S. Pat. No. 5,485,939 to Tucker, U.S. Pat. No. 5,732,852 to Baker et al., U.S. Pat. No. 5,782,378 to Hart et al., U.S. Pat. No. 5,788,115 to Halliburton, U.S. Pat. No. 5,833,117 to Kovens et al., U.S. Pat. No. 5,897,022 to Mann and U.S. Pat. No. 6,056,151 to Peery et al.

While these prior art device appear to be mostly satisfactory in use for the specific purposes for which they were designed none of them seem to provide an optimum solution to the problem of being able to store large quantities of lollipops while at the same time being able to dispense them reliably one at a time.

Consequently, a need still exists for an innovation which will provide a solution to the aforementioned problem in the prior art without introducing any new problems in place thereof.

SUMMARY OF THE INVENTION

The present invention provides a vending machine designed to satisfy the aforementioned need. The vending machine of the present invention incorporates enhanced features for storing and dispensing of products, such as lollipops, in a highly organized and reliable manner. More particularly, the vending machine of the present invention provides a product storage and dispensing magazine and a product separation fixture which rotatably supports the magazine so as to provide enhanced repeatable dispensing of the lollipops from the machine one at a time in response to each user inserting a coin into and turning a knob of a coin deposit station of the machine.

Accordingly, the present invention is directed to a machine for vending products which comprises: (a) a free-standing housing having upper, middle and lower sections, the lower section including a product discharge station, the middle section defining an opening to the lower section; (b) a product storage and dispensing magazine disposed in the upper section of the housing and having means defining a circular row of vertical channels having lower open ends such that products can be stored in circularly-arranged vertical columns thereof within the vertical channels with the vertical columns of products tending to move and feed downward through the open lower ends of the vertical channels due to the influence of the force of gravity; (c) a magazine indexing drive mechanism disposed in the upper and middle sections of the housing and being drivingly coupled to the magazine and operable to cause rotation of the magazine such that the magazine can be incrementally rotated about a circular path; (d) a product separation fixture disposed in and mounted by the middle section of the housing adjacent to the lower open ends of the vertical channels of the magazine such that the magazine is rotatably supported by the separation fixture and in response to operation of the drive mechanism the magazine rotates relative to the separation fixture and advances in succession lowermost ones of the products in the vertical columns thereof to the opening in the middle section of the housing where the products one at a time fall downward through the opening, the separation fixture overlying the opening and blocking a vertical path to the opening of products from the vertical columns thereof directly above the opening while still allowing passage of the products into the lowermost circular row thereof and one at a time to below the separation fixture and into the opening of the middle section of the housing; and (e) means disposed in the lower section of the housing for receiving a product which drops through the opening of the middle section of the housing and transferring the product through the lower section of the housing and into the product discharge station thereof.

More particularly, the drive mechanism is drivingly coupled to the magazine at spaced apart lower and upper portions of the magazine. The magazine is rotatably supported by the separation fixture by a plurality of ball bearings seated on a central platform of the separation fixture. A resiliently yieldable mechanism is supported on an upstanding annular wall of the separation fixture, extends across the path of the lowermost products and includes is a spring-biased pivotally-movable flap operable to impart a positive downwardly-directed force on the lowermost product that will push it downward toward the opening in the middle section of the housing. Also, portions of the housing and the separation fixture define a path for passage of products to the opening which is located outwardly of and bypasses the indexing drive mechanism.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
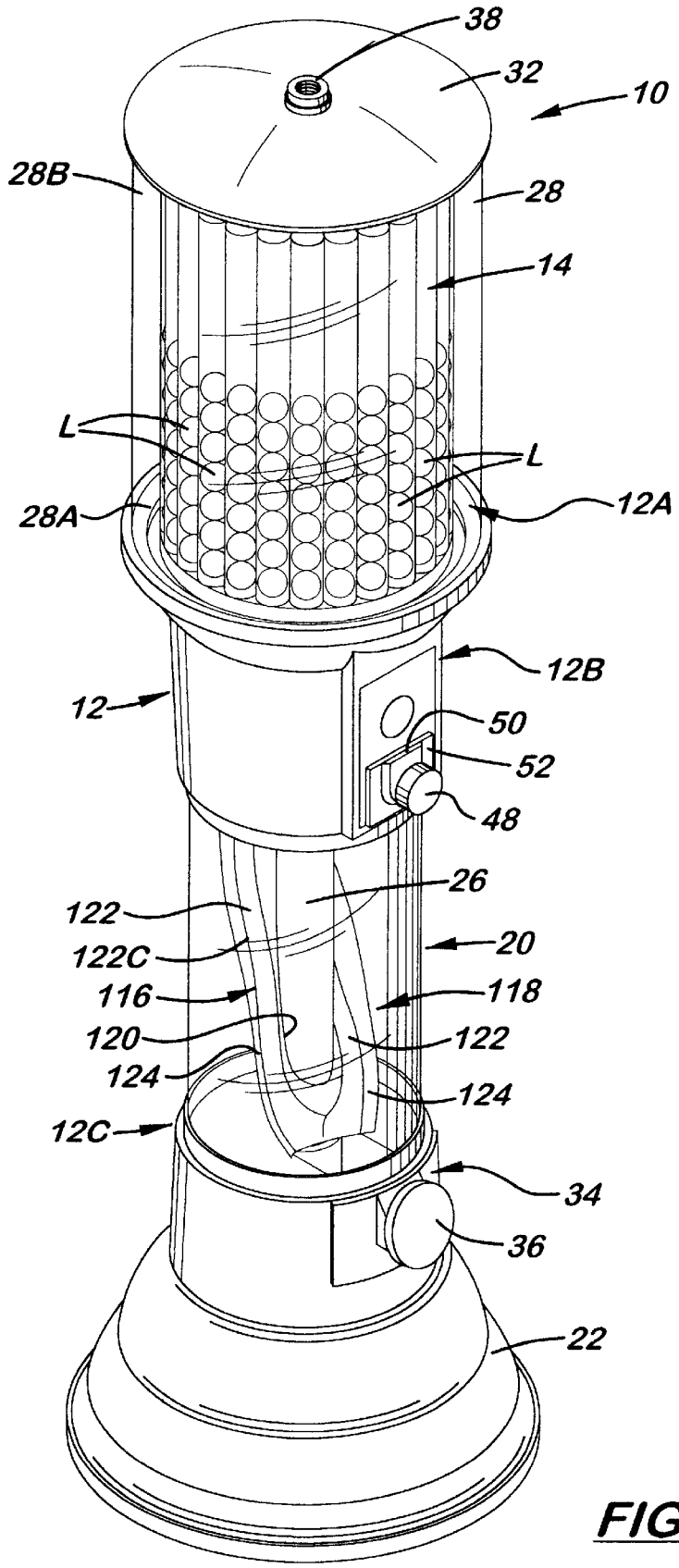
FIG. 1 is a perspective view of a machine of the present invention for reliably vending products one at a time.
Figure 2A:
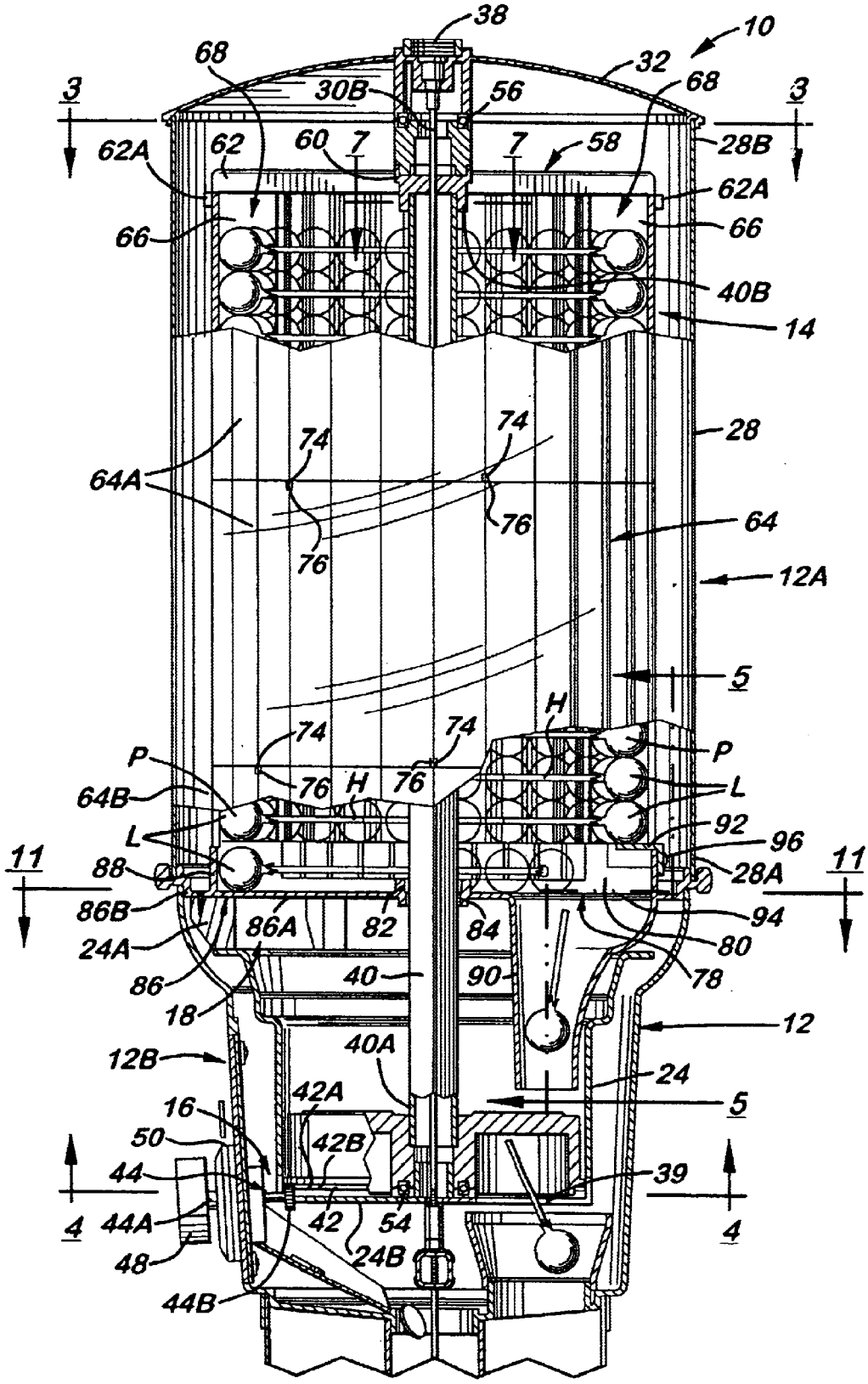
FIG. 2 is an enlarged side elevational view of the machine of FIG. 1 showing some portions broken away and other portions in section.
Figure 2B:
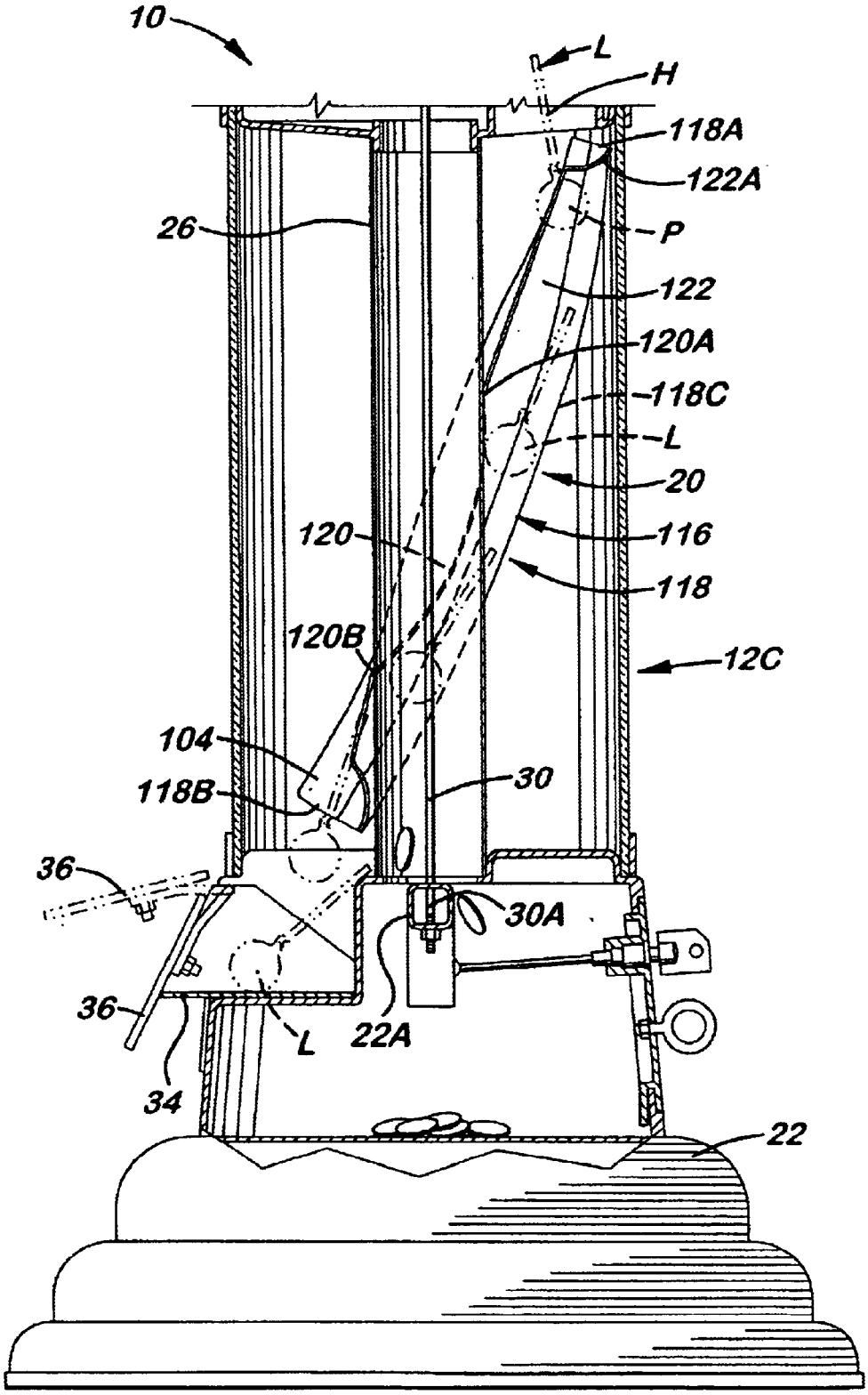
Figure 3:
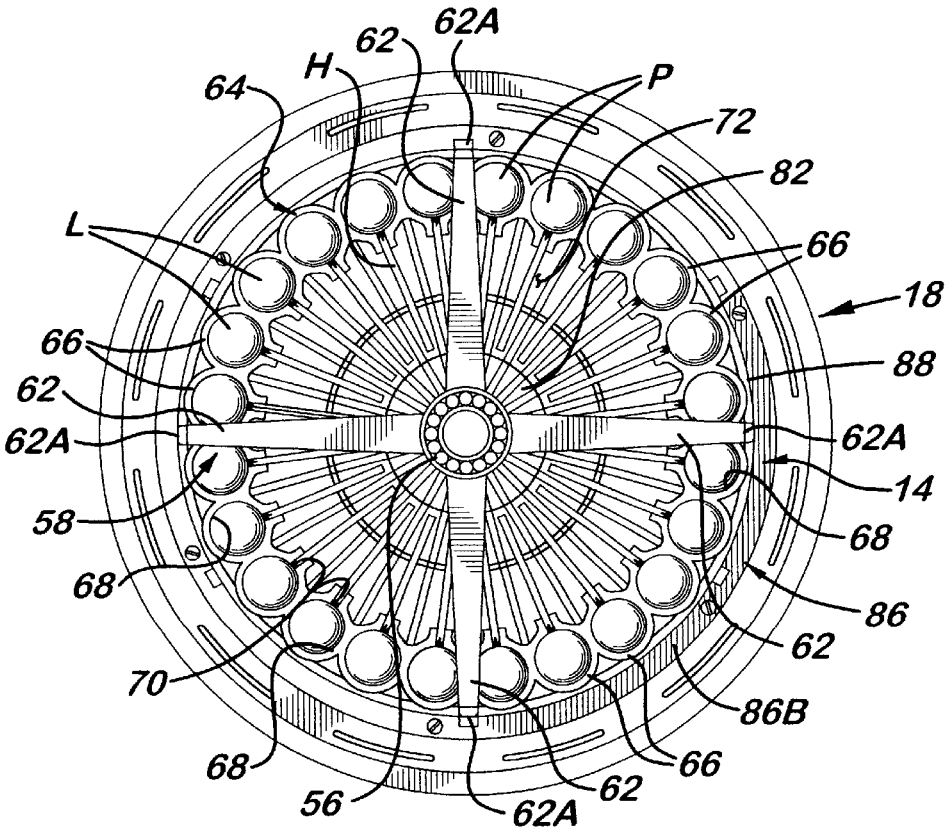
FIG. 3 is a top plan view of the machine as seen along line 3—3 of FIG. 2.

Referring to the drawings and particularly to FIGS. 1 and 2, there is illustrated a coin-operated product vending machine, generally designated 10, of the present invention for reliably dispensing products, such as lollipops L, one at a time. The machine 10 basically includes a freestanding housing 12, as best seen in FIGS. 1 and 2, having upper, middle and lower sections 12A, 12B, 12C, a product storage and dispensing magazine 14, as best seen in FIGS. 1–3 and 5, disposed in the upper section 12A of the housing 12, a magazine indexing drive mechanism 16, as been seen in FIGS. 1–4 and 7, disposed in the upper and middle sections 12A, 12B of the housing 12, a product separation fixture 18, as best seen in FIGS. 2, 5, 6 and 8–14 disposed in the middle section 12B of the housing 12, and a product transfer arrangement 20, as best seen in FIGS. 1 and 2, disposed in the lower section 12C of the housing 12.

Referring still to FIGS. 1 and 2, the freestanding housing 12 of the machine 10 also includes a bottom base 22, a middle receptacle or hopper 24, an elongated tubular lower support member 26, an outer tubular enclosure 28, a central elongated rigid tie or connector rod 30, and a top lid 32. The bottom base 22 is located in the lower section 12C of the housing 12 where the housing 12 is supported upon a support surface, such as a floor. The bottom base 22 includes a product discharge station 34 and a pivotal door 36 thereon movable between a closed position and an open position for respective blocking and allowing access to products received by the product discharge station 34. The elongated lower support member 26 is mounted upon the bottom base 22 and extends upwardly through the lower section 12C of the housing 12 and supports the middle hopper 24 in the middle section 12B of the housing 12 in a spaced relationship above the bottom base 22. The outer tubular enclosure 28 is cylindrical in configuration and made of a transparent material, encloses the upper section 12A of the housing 12, and is supported at its open lower end 28A upon an upper periphery 24A of the middle hopper 24. As best seen in FIG. 2, the central rigid tie or connecting rod 30 is fixedly mounted at a lower end 30A to a cross member 22A of the bottom base 22, extends therefrom upwardly through the lower tubular support member 26 of the lower section 12C of the housing 12 and through a bottom panel 24B of the middle hopper 24 of the middle section 12B of the housing 12, and upwardly therefrom through the upper section 12A of the housing 12 to an upper end 30B disposed above an open upper end 28B of the outer tubular enclosure 28. The middle hopper 24 has an opening 39 defined through the bottom panel 24B thereof. The top lid 32 seats upon the upper end 28B of the outer tubular enclosure 28 and is releasably fastened by a suitable conventional key lock mechanism 38 to the upper end 30B of the central rigid connecting rod 30.

Figure 4:
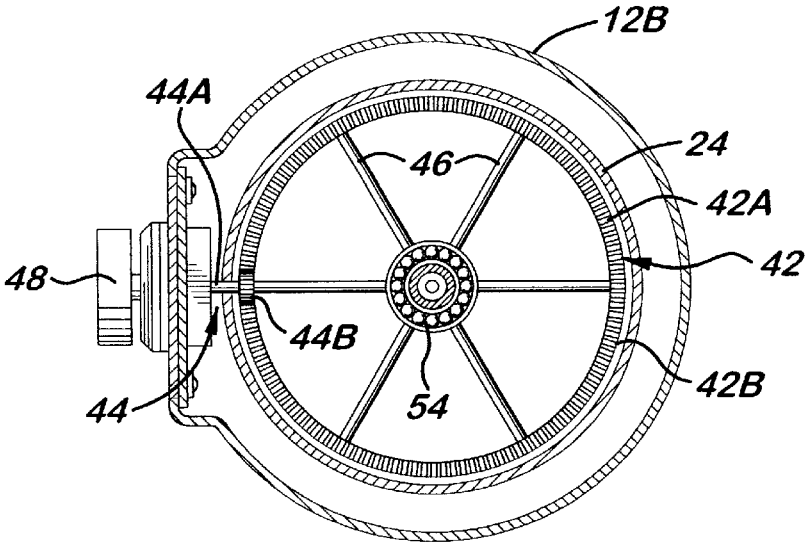
FIG. 4 is a cross-sectional view of the machine taken along line 4—4 of FIG. 2.

Referring now to FIGS. 1–4 and 7, the magazine indexing drive mechanism 16 is rotatably supported on the bottom panel 24B of the middle hopper 24 of the housing 12. The magazine indexing drive mechanism 16 includes a rigid central hollow vertical driven shaft 40 having opposite lower and upper ends 40A, 40B, a horizontal annular driven gear 42 having teeth 42A arranged in a circular row and projecting downwardly from a bottom side 42B (as seen in FIGS. 2 and 4) of the driven gear 42, and a peripherally-located drive gear 44 having a drive shaft 44A and teeth 44B defined circumferentially about the drive shaft 44A of the drive gear 44 and projecting radially outward therefrom. The central rod 30 of the housing 12 extends vertically through the central hollow vertical driven shaft 40 of the drive mechanism 16. The annular driven gear 42 encircles and is spaced radially outwardly from the lower end 40A of the driven shaft 40 by a plurality of members in the form of radial spokes 46 extending between and rigidly interconnecting the annular driven gear 42 and driven shaft 40. The teeth 44A of the drive gear 44 mesh with the teeth 42A in the circular row thereof on the bottom side 42B of the driven gear 42 which faces toward the bottom panel 24B of the middle hopper 24. The outer end of the drive shaft 44A of the drive gear 44 mounts a knob 48 at the exterior of the middle hopper 24 for rotation with the drive shaft 44A when turned by a user after inserting a coin into a coin slot 50 of a conventional coin deposit station 52 supported by the middle hopper 24 of the machine 10.

The magazine indexing drive mechanism 16 also includes lower and upper annular bearings 54, 56 and an upper spider 58. The lower and upper annular bearings 54, 56 are disposed respectively at the lower and upper ends 40A, 40B of the central driven shaft 40. The lower bearings 54 rotatably mount and support the driven shaft 40 upon the bottom panel 24B of the middle hopper 24 and enable the driven shaft 40 and the driven and drive gears 42, 44 to be rotated by a user merely turning the knob 48. The upper spider 58 has a central hub 60 and a plurality of radial arms 62 angularly spaced apart about ninety degrees and rigidly attached to and extending radially outwardly from the hub 60. The hub 60 is received over the upper end 40B of the central vertical hollow driven shaft 40 and fixedly attached thereto such that the upper spider 58 will rotate with the driven shaft 40. The radial arms 62 of the upper spider 58 have respective lugs 62A on the outer ends thereof which extend downwardly and interfit with portions of the upper periphery of the product storage and dispensing magazine 14 so as to transmit the rotational motion of the driven shaft 40 and upper spider 58 to the magazine 14. The upper annular bearing 56 is disposed between the central hub 60 of the upper spider 58 and the top lid 32.

Referring now to FIGS. 1–3 and 5, the product storage and dispensing magazine 14 is rotatably supported upon the the product separation fixture 18. The magazine 14 includes means in the form of a generally cylindrical body 64 having a plurality of partitions 66 being vertically arranged and circumferentially spaced about and fixedly attached one to the next so as to define a circular row of vertical channels 68 of the magazine 14 having upper and lower open ends 68A, 68B. The products, such as lollipops L, can be stored in the circumferentially-arranged vertical channels 68 one above the next to form circularly-arranged vertical columns of the products. The partitions 66 of the magazine body 64 also define vertical slots 70 along their inner edges 66A which face toward one another and open into a central interior cylinder of space 72 within the magazine body 64 and also into the vertical channels 68. Head pieces P of the lollipops L are disposed in circularly-arranged columns thereof within the vertical channels 68 with their handles H extending inwardly toward the driven shaft 40 through the slots 70 such that each lollipop L is generally disposed in a horizontal orientation. Because of their vertical orientations, the columns of lollipops L will tend to move and feed downward through the open lower ends 68B of the vertical channels 68 due solely to the influence of the force of gravity and without the need for application of any supplemental mechanical force thereto. The magazine body 64 is made of a suitable transparent material such that the products can be seen both through the body 64 of the magazine 14 and the outer tubular enclosure 28 of the housing 12.

The magazine body 64 is disposed in a concentric relationship about the central driven shaft 40 and preferably is made up of a plurality of subunits or segments 64A, 64B which fit together end-to-end and thus stack one on top of another to form the body 64. This reduces the handling weight of the magazine 14 for persons who must lift the magazine during resupplying or replenishing of lollipops in the machine 10. The segments 64A have complementary male and female elements 74, 76 at the opposite ends thereof which interfit to retain the segments 64A, 64B together in the end-to-end stacked relationship.

Figure 6:
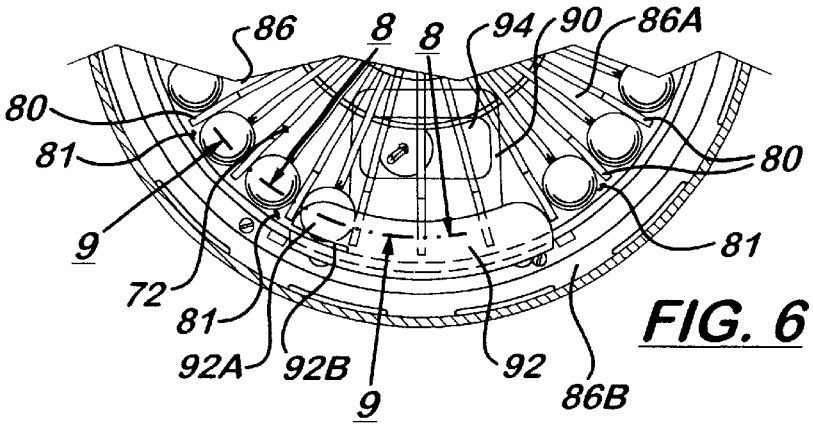
FIG. 6 is a fragmentary top plan view as seen along line 6–6 of FIG. 5.
Figure 5:
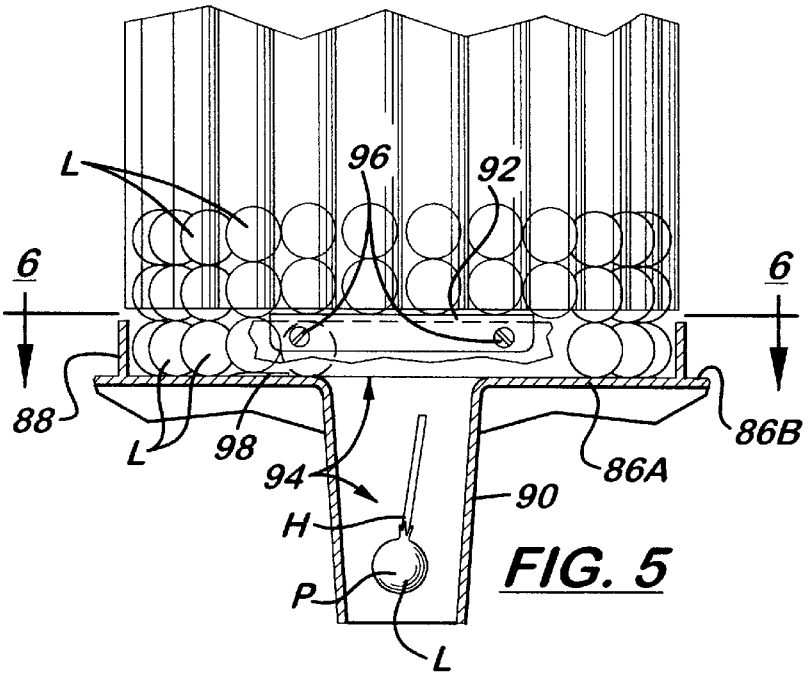
FIG. 5 is a fragmentary side elevational view of the machine taken along line 5–5 of FIG. 2.
Figure 7:
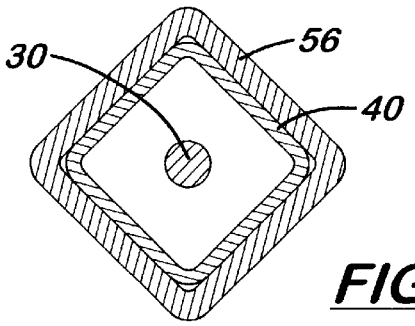
FIG. 7 is an enlarged cross-sectional view taken along line 7–7 of FIG. 2.

The lowermost one of the segments 64B of the magazine body 64 is different from the other segments 64A in that segment 64B has a lower structure 78 rigidly attached to and disposed below the partitions 66 of the segment 64B. The lower structure 78 includes a plurality of radially outwardly directed divider tabs 80, as seen in FIGS. 2 and 6, being circumferentially spaced apart from one another and also spaced below and between the lower open ends 68B of the vertical channels 68 and defining compartments 81 between the divider tabs 80 which respectively receive therein the lowermost products which then make up a lowermost circular row of the products, such as best seen in FIG. 6. The lower structure 78 also includes a bottom central hub 82 which defines a central hole 84 adapted to receive therethrough the central driven shaft 40. Preferably, both the driven shaft 40 and central hole 84 have a similar rectangular shape such that rotation of the central driven shaft 40 will impose a rotational force on the magazine body 64 via the bottom central hub 82 of the bottom structure 78 of the lowermost segment 64B that will assist or augment the rotational force applied on the upper periphery of the magazine body 64 by the lugs 62A on the radial arms 62 of the upper spider 58 in causing the rotation of the magazine body 64 merely by a user turning of the knob 48. Also, each time the user turns the knob 48 of the coin deposit station 52 after inserting a coin in the coin slot 50 thereof, the drive gear 44 rotates through an angular displacement sufficient to move or index the driven gear 42 through an angular distance equal to the center-to-center distance between the vertical channels 68 and thus between the vertical columns of lollipops L. By way of example, there are twenty-four vertical channels 68. Thus, the magazine 14 is rotatably indexed through an angular displacement equal to one twenty-fourth of its circumference each time the knob 48 is turned to cause the vending of a lollipop L.

Referring to FIGS. 2, 5, 6 and 8–14, the product separation fixture 18 is mounted on and about the upper periphery 24A of the middle receptacle or hopper 24 of the housing 12. The magazine body 64 at the lower structure 78 of its lowermost segment 64B rests upon the separation fixture 18 such that the magazine 14 is rotatably supported thereon and can be rotated relative to the separation fixture 18. The separation fixture 18, more particularly, basically includes a circular platform 86, an upstanding annular fence or wall 88, a funnel 90 and a barrier plate 92.

The circular platform 86 of the fixture 18 has an inner main portion 86A and an outer peripheral rim portion 86B supported on the upper periphery 24A of the middle hopper 24 of the housing 12 such that the inner main portion 86A of the platform 86 is disposed in a horizontal orientation somewhat below the elevation of the upper periphery 24A of the middle hopper 24. The upstanding annular wall 88 of the fixture 18 is fixed upright upon the circular platform 86 adjacent to the outer peripheral rim portion 86B thereof and outwardly of and adjacent to the open lower ends 68B of the vertical channels 68 and to the divider tabs 80 of the lowermost segment 64B of the magazine body 64 so as to permit the magazine 14 to be rotated without interference from the annular wall 88 and with the vertical channels 68 located inside the annular wall 88 and thus aligned with and disposed above the inner main portion 86A of the circular platform 86 such that the lowermost ones of the products in the vertical columns thereof will rest upon the inner main platform portion 86A within the respective compartments 82 between the divider tabs 80 and adjacent to the annular wall 88 and be moved therealong by the divider tabs 80 with rotation of the magazine 14. The inner main portion 86A of the circular platform 86 has a plurality of recesses 87 defined therein which are circumferentially spaced about a central circular opening 86C of the platform 86 and a plurality of ball bearings 89 seated in the recesses 87 and on which the magazine body 64 at the lower structure 78 of its lowermost segment 64B rests upon the separation fixture 18 such that the magazine 14 is rotatably supported thereon and can be rotated relative to the separation fixture 18. Also, the inner main portion 86A of the circular platform 86 has an annular depression 86D defined therein which underlies and is spaced below the bottom structure 78 of the lowermost segment 64B of the magazine body 64 so as to create clearance between the bottom structure 78 and the inner main portion 86A of the circular platform 86 which prevents a handle H of a lollipop from wedging therebetween and causing a jamming of the rotation of the magazine 14 relative to the circular platform 86 of the separation fixture 18.

The funnel 90 of the fixture 18 is attached on and depends below the inner main portion 86A of the circular platform 86 so as to define a passageway 94 therethrough. The funnel 90 is disposed above and aligned with the opening 39 of the middle hopper 24 of the housing 12 such that products advanced by rotation of the magazine 14 to the platform passageway 94 will fall downward through the funnel 90 and therefrom directly to and through the opening 39 of the middle hopper 24 of the housing 12 and therefrom via the product transfer arrangement 20 to the product discharge station 34 of the lower section 12C of the housing 12.

Figure 12:
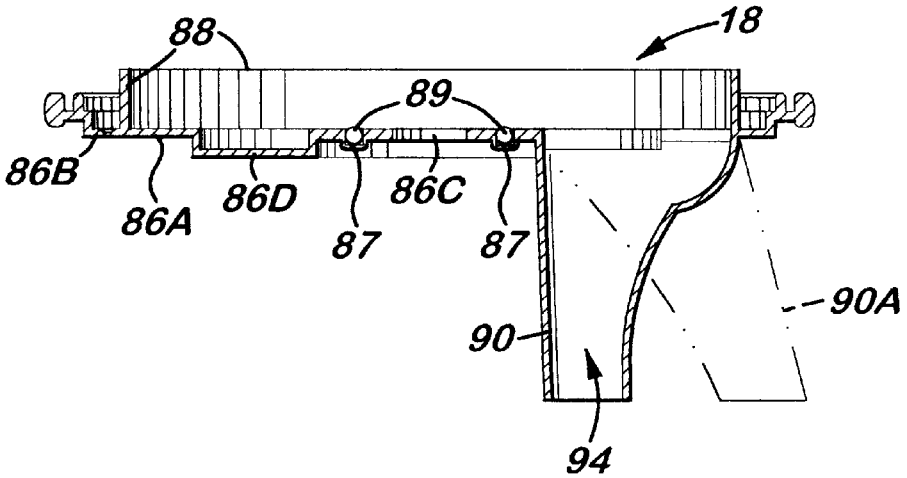
FIG. 12 is a vertical sectional view of the separation fixture taken along line 12—12 of FIG. 11.

Alternatively, in order to avoid interference by the radial spokes 46 of the rotatable annular driven gear 42 with the dropping of the lollipops L through the funnel 90 and the hole 39 such that products such as lollipops L can become wedged between one of the radial spokes 46 and a portion of the edge of the hole 39, portions of the funnel 90 and an adjacent middle section 12B of the housing 12 can be offset, as shown by the dashed lines 90A and 12D in FIGS. 12 and 2, to define an alternate path to the lower section 12C of the housing 12 which is located offset outwardly from and thus bypasses the driven gear 42 and avoids the catching of a lollipop L on the radial spokes 46 of the driven gear 42.

The barrier plate 92 is mounted such as by fasteners 96 to an arcuate segment of the upstanding annular wall 88 and extends inwardly from the top 88A of the annular wall 88 in a horizontal orientation parallel to and spaced above the inner main portion 86A of the circular platform 86 such that the barrier plate 92 is spaced directly above the passageway 94 through the inner main portion 86A of the circular platform 86. The barrier plate 92 thus overlies and blocks a direct vertical path to the platform passageway 94 of products from those of the vertical columns thereof located directly above the passageway 94 while still allowing dropping of other products angularly displaced from the location of the barrier plate 92 into the lowermost circular row of the products lying on the inner main portion 86A of the platform 86 and movement of the lowermost products one at a time to below the barrier plate 92 and into the passageway 94. As seen in FIG. 2, the lower ends 68A of the vertical channels 68 of the lowermost segment 64B of the magazine body 64 are disposed at an elevation above the barrier plate 92 of the separation fixture 18 and thus pass over the barrier plate 92 upon rotation of the magazine 14 whereas the divider tabs 80 of the lower structure 78 of the lowermost segment 64B of the magazine body 64 are disposed at an elevation below the barrier plate 92 and thus pass under the barrier plate 92 upon rotation of the magazine 14. Each of the divider tabs 80 is spaced a sufficient distance below the elevation of the barrier plate 92 so as to eliminate the possibility of the wrapper of the product from wedging or catching between divider tab 80 and the barrier plate 92 and thereby preventing the product from dropping into the passageway 94.

Figure 8:
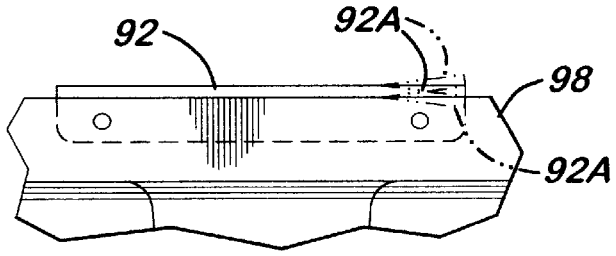
FIG. 8 is an enlarged fragmentary side elevational view of a product separation fixture of the machine as seen along line 8—8 of FIG. 6.

As seen in FIGS. 6 and 8, the barrier plate 92 also has a leading edge portion 92A which has a short slit 92B made therein that separates the leading edge portion 92A from the upstanding annular wall 88 and thereby adapts the leading edge portion 92A to flex in the vertical direction. Such flexing capability facilitate separation of each lowermost product from the next lowermost product immediately above it in the same vertical column as the products are advanced into contact with the leading edge portion 92A of the barrier plate 92 of the fixture 18 and thus diminishes the likelihood that both products can become wedged between the barrier plate 92 and the platform 86 and impede rotation of the magazine 14 or allow both products to drop at the same time through the passageway 94.

Figure 9:
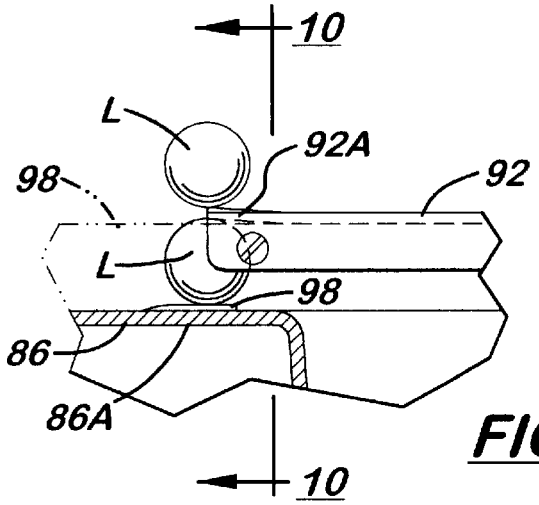
FIG. 9 is an enlarged fragmentary sectional view of the separation fixture as seen along line 9—9 of FIG. 6.

Furthermore, as seen in FIG. 9, the inner main portion 86A of the platform 86 below the flexible leading edge portion 92A of the barrier plate 92 and adjacent to the passageway 94 has an inclined ramp 98 defined thereon which facilitates lifting vertically of the lowermost product and thus next lowermost product in the same vertical column which assists separating these two products from one another, especially in the case of smaller sizes of products, by the flexible leading edge portion 92A of the barrier plate 92 as these products advance into contact with the leading edge portion 92A of the barrier plate 92.

Figure 10:
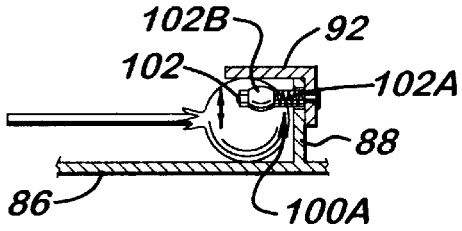
FIG. 10 is a side elevational view of the separation fixture as seen along line 10—10 of FIG. 9.
Figure 11:
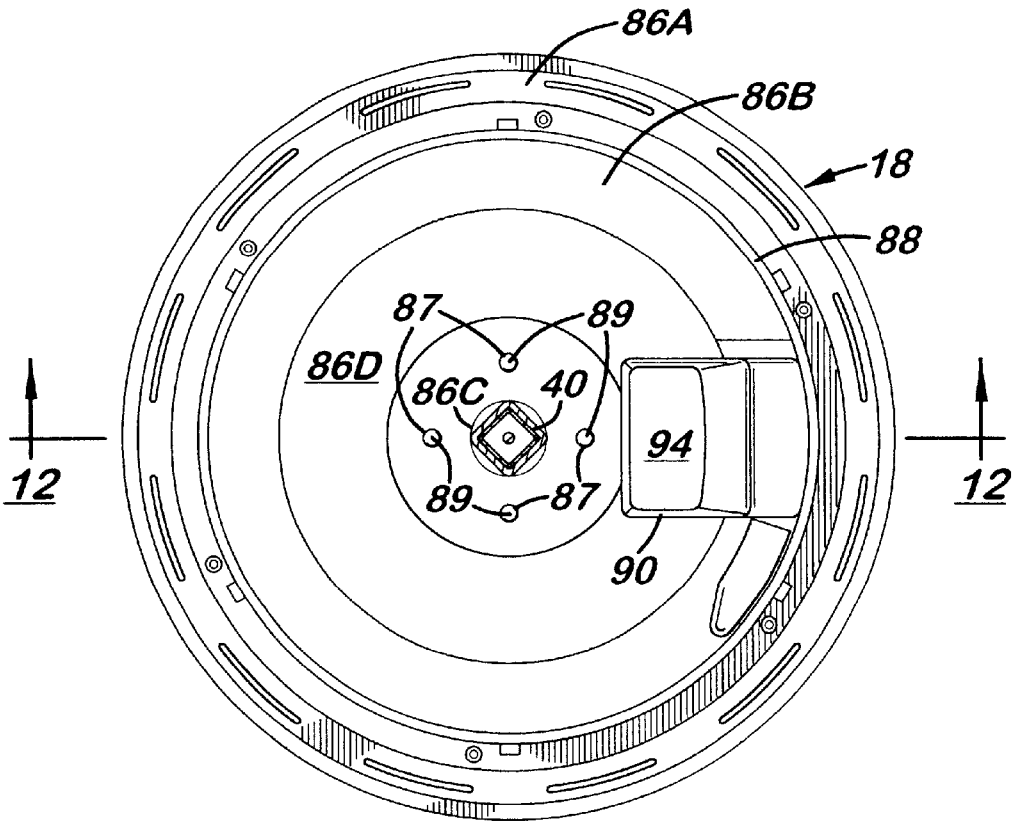
FIG. 11 is a top plan view of the separation fixture as seen along line 11—11 of FIG. 2.

Finally, as seen in FIG. 10, the upstanding annular wall 88 of the fixture 18 supports a resiliently yieldable mechanism 100 which, in a first embodiment, takes the form of a finger 102 mounted thereto and extending outwardly over the passageway 94 adjacent to and downstream of the flexible leading edge portion 92A of the barrier plate 92 relative to the direction of movement of the magazine 14 along its circular path. The finger 102 is adapted to be engaged by and impart a positive downwardly-directed force on the lowermost product that will push the lowermost product downward toward the passageway in the platform 86 of the fixture 18. The finger 102 may be formed by a coiled spring 102A attached to the annular wall 88 and a roller 102B rotatably mounted to an outer end of the spring 102A. The positive action of the finger 102 against each lowermost product will also assist in eliminating a wrapper of the product from catching on some adjacent structure and preventing the product from dropping into the passageway 94. The roller 102B will cause the finger 102 to flex upwardly and allow passage of each of the divider tabs 80 in response to the tab 80 contacting the roller 102B.

Figure 13:
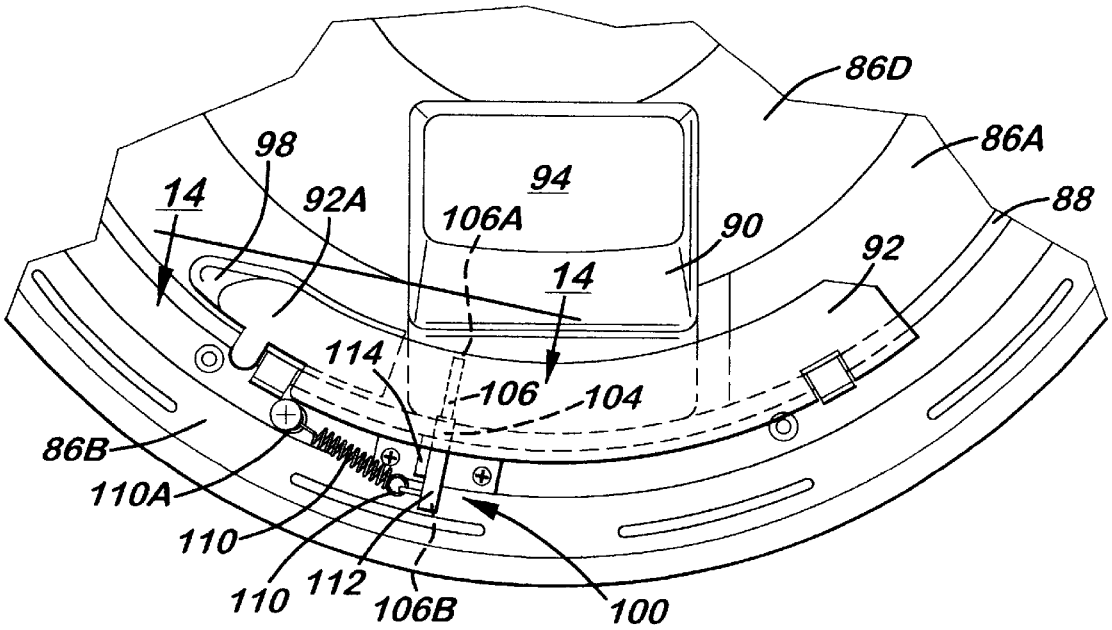
FIG. 13 is another enlarged fragmentary view of the separation fixture of the machine.
Figure 14:
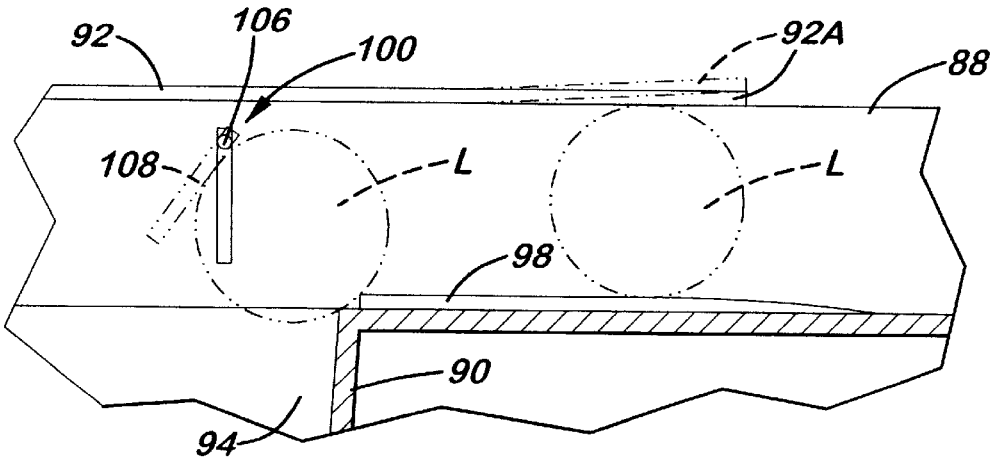
FIG. 14 is an enlarged fragmentary side elevational view of the separation fixture as seen along line 14—14 of FIG. 13.

In a second embodiment shown in FIGS. 13 and 14, the resiliently yieldable mechanism 100 includes, instead of the spring-like finger 102, a mounting sleeve 104, an elongated shaft 106, a flap 108 and a spring 110. The mounting sleeve 104 is rigidly attached to and extends transversely to the upstanding annular wall 88 of the fixture 18. The elongated shaft 106 extends through and is rotatable relative to the mounting sleeve 104. The flap 108 is rigidly attached to and extends downwardly from an inner end portion 106A of the shaft 106. A tab 112 is rigidly attached to and extends downwardly from an outer end portion 106B of the shaft 106. The spring 110 is anchored at one end 110A to an outer peripheral rim portion 86B of the circular platform 86 and is attached at the opposite end 110B to the tab 112. The spring 110 biases the tab 112 to assume an initial or starting position against a stop 114 fastened to and extending outwardly from the annular wall 88 of the fixture 18. The flap 108 of the shaft 106 is adapted to be engaged by and rotated against the pull of the spring 110 so as to extend the spring 110 and thus impart a positive downwardly-directed force, as transmitted from the spring 110, on the lowermost product that will push the lowermost product downward toward the passageway in the platform 86 of the fixture 18. The spring 110 also will allow the flap 108 to pivot against the bias of the spring 110 so as to allow passage of each divider tab 80 in response to the tab 80 contacting the flap 108.

Referring now to FIGS. 1 and 2, the product transfer arrangement 20 extends upwardly from the product discharge station 24 to the product separation fixture 18 of the middle section 12B of the frame 12. The product transfer arrangement 20 takes the form of a curvy slide delivery chute 116. The delivery chute 116 includes an elongated body 118 having an overall shallow arcuate longitudinal configuration and a W-shaped cross-sectional configuration. The body 118 preferably is made of a suitable plastic material, is installed at a relatively steeply-inclined angle, as seen in FIG. 2, and has a central teardrop-shaped central hole 120 formed therein which receives therethrough the lower tubular support member 26 of the housing 12. The teardrop-shaped hole 120 has a pointed upper end 120A and a rounded lower end 120B.

The body 118 of the delivery chute 116 includes a pair of recessed channels 122, integrally formed therein, which extend between upper and lower ends 118A, 118B of the body 118 and are provided in a wavy or curvy longitudinal configuration in the body 118 on a pair of opposite sides of the central hole 120. The channels 122 protrude below the rest of the body 118 and extend from the upper end 118A to the opposite lower end 118B of the body 118 such that a product can slide downward along either one of the channels 122 in being transferred from the opening 39 in the middle hopper 24 to the lower discharge station 34 of the machine 10. The channels 122, being substantially mirror images of one another, merge together at their inlet and outlet ends 122A, 122B located at the upper and lower ends 118A, 118B of the body 118 and thus encompass a central portion 118C of the body 118 which surrounds the central hole 120 therein. The central portion 118C of the body 118 has a generally inverted V-shaped configuration. The channels 122 along which the dispensed products slide by having the wavy or curvy longitudinal configurations cause the products to move along identically shaped paths and thus provide the motion of the products with an entertainment aspect which will attract the attention of consumers.

The body 118 of the delivery chute 116 further includes a pair of side rails 124, each being integrally formed on the body 118 and protruding thereabove along one of the opposite outer sides 122C of the recessed channels 122. The side rails 124 function so as to reduce the possibility of dislocation of a product outwardly from their paths of movement down the slide channels 122 of the body 118 of the delivery chute 116.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A machine for vending products, comprising:

(a) a freestanding housing having upper, middle and lower sections, said lower section including a product discharge station, said middle section defining an opening to said lower section;

(b) a product storage and dispensing magazine disposed in said upper section of said housing and having means defining a circular row of vertical channels having lower open ends such that products can be stored in circularly-arranged vertical columns thereof within said vertical channels with the vertical columns of products tending to move and feed downward through said open lower ends of said vertical channels due to the influence of the force of gravity;

(c) a magazine indexing drive mechanism disposed in said upper and middle sections of said housing and being drivingly coupled to said magazine at least at a lower portion of said magazine and operable to cause rotation of said magazine such that said magazine can be incrementally rotated about a circular path;

(d) a product separation fixture disposed in and mounted by said middle section of said housing adjacent to said lower open ends of said vertical channels of said magazine such that said magazine is rotatably supported by said separation fixture and in response to operation of said drive mechanism said magazine rotates relative to said separation fixture and advances in succession lowermost ones of the products in the vertical columns thereof to said opening in said middle section of said housing where the products one at a time fall downward through said opening, said separation fixture overlying said opening and blocking a vertical path to said opening of products from the vertical columns thereof directly above said opening while still allowing passage of the products into the lowermost circular row thereof and one at a time to below said separation fixture and into said opening of said middle section of said housing; and (e) means disposed in said lower section of said housing for receiving a product which drops through said opening of said middle section of said housing and transferring the product through said lower section of said housing and into said product discharge station thereof.

2. The machine of claim 1 wherein said drive mechanism is drivingly coupled to said magazine at spaced apart lower and upper portions of said magazine.

3. The machine of claim 1 wherein said separation fixture includes a central platform having a plurality of ball bearings seated thereon rotatably supporting said magazine on said central platform of said product separation fixture.

4. The machine of claim 1 wherein said separation fixture includes a resiliently yieldable mechanism adapted to engage and impart a downwardly-directed force on the lowermost product that will push the lowermost product downward toward said opening in said middle section of said housing.

5. The machine of claim 4 wherein said resiliently yieldable mechanism is a spring-biased pivotally-movable flap.

6. The machine of claim 4 wherein said separation fixture includes a central platform and an upstanding annular wall attached on and extending about said central platform, said resiliently yieldable mechanism being supported on said annular wall.

7. The machine of claim 6 wherein said resiliently yieldable mechanism is a spring-biased pivotally-movable flap.

8. A machine for vending products, comprising:

(a) a freestanding housing having upper, middle and lower sections, said lower section including a product discharge station, said middle section defining an opening to said lower section;

(b) a product storage and dispensing magazine disposed in said upper section of said housing and having means defining a circular row of vertical channels having lower open ends such that products can be stored in circularly-arranged vertical columns thereof within said vertical channels with the vertical columns of products tending to move and feed downward through said open lower ends of said vertical channels due to the influence of the force of gravity;

(c) a magazine indexing drive mechanism disposed in said upper and middle sections of said housing and being drivingly coupled to said magazine and operable to cause rotation of said magazine such that said magazine can be incrementally rotated about a circular path;

(d) a product separation fixture disposed in and mounted by said middle section of said housing adjacent to said lower open ends of said vertical channels of said magazine such that said magazine is rotatably supported by said separation fixture and in response to operation of said drive mechanism said magazine rotates relative to said separation fixture and advances in succession lowermost ones of the products in the vertical columns thereof to said opening in said middle section of said housing where the products one at a time fall downward through said opening, said separation fixture overlying said opening and blocking a vertical path to said opening of products from the vertical columns thereof directly above said opening while still allowing passage of the products into the lowermost circular row thereof and one at a time to below said separation fixture and into said opening of said middle section of said housing, said separation fixture including a resiliently yieldable mechanism having a spring-biased pivotally-movable flap overlying said opening and adapted to engage and impart a downwardly-directed force on the lowermost product that will push the lowermost product downward toward said opening of said middle section of said housing; and (e) means disposed in said lower section of said housing for receiving a product which drops through said opening of said middle section of said housing and transferring the product through said lower section of said housing and into said product discharge station thereof.

9. The machine of claim 8 wherein said separation fixture includes a central platform and a barrier plate spaced above said central platform and overlying said opening of said middle section of said housing, said barrier plate having a leading edge portion that is flexible to enable separation of a lowermost product from a product immediately thereabove.

10. The machine of claim 8 wherein said separation fixture includes a central platform and an upstanding annular wall attached on and extending about said central platform, said resiliently yieldable mechanism being supported on said annular wall.

11. A machine for vending products, comprising:

(a) a freestanding housing having upper, middle and lower sections, said lower section including a product discharge station, said middle section defining an opening to said lower section;

(b) a product storage and dispensing magazine disposed in said upper section of said housing and having means defining a circular row of vertical channels having lower open ends such that products can be stored in circularly-arranged vertical columns thereof within said vertical channels with the vertical columns of products tending to move and feed downward through said open lower ends of said vertical channels due to the influence of the force of gravity;

(c) a magazine indexing drive mechanism disposed in said upper and middle sections of said housing and being drivingly coupled to said magazine and operable to cause rotation of said magazine such that said magazine can be incrementally rotated about a circular path;

(d) a product separation fixture disposed in and mounted by said middle section of said housing adjacent to said lower open ends of said vertical channels of said magazine such that said magazine is rotatably supported by said separation fixture and in response to operation of said drive mechanism said magazine rotates relative to said separation fixture and advances in succession lowermost ones of the products in the vertical columns thereof to said opening in said middle section of said housing where the products one at a time fall downward through said opening, said separation fixture overlying said opening and blocking a vertical path to said opening of products from the vertical columns thereof directly above said opening while still allowing passage of the products into the lowermost circular row thereof and one at a time to below said separation fixture and into said opening of said middle section of said housing, said housing and separation fixture having portions defining a path for passage of products to said opening which is located outwardly of and bypasses said drive mechanism; and (e) means disposed in said lower section of said housing for receiving a product which drops through said opening of said middle section of said housing and transferring the product through said lower section of said housing and into said product discharge station thereof.

12. The machine of claim 11 wherein said drive mechanism is drivingly coupled to said magazine at spaced apart lower and upper portions of said magazine.

13. The machine of claim 11 wherein said separation fixture includes a central platform having a plurality of ball bearings seated thereon rotatably supporting said magazine on said central platform of said product separation fixture.

14. The machine of claim 11 wherein said separation fixture includes a resiliently yieldable mechanism adapted to engage and impart a downwardly-directed force on the lowermost product that will push the lowermost product downward toward said opening in said middle section of said housing.

15. The machine of claim 14 wherein said resiliently yieldable mechanism is a spring-biased pivotally-movable flap.

16. The machine of claim 14 wherein said separation fixture includes a central platform and an upstanding annular wall attached on and extending about said central platform, said resiliently yieldable mechanism being supported on said annular wall.

17. The machine of claim 16 wherein said resiliently yieldable mechanism is a spring-biased pivotally-movable flap.

* * * * *